United States Patent [19]

Allen

[11] 4,148,139

[45] Apr. 10, 1979

[54] HAND RAZOR ASSEMBLY

[76] Inventor: Dillis V. Allen, 1326 Algonquin Rd., Schaumburg, Ill. 60172

[21] Appl. No.: 689,471

[22] Filed: May 24, 1976

[51] Int. Cl.[2] ..... B26B 21/00

[52] U.S. Cl. ..... 30/34.2

[58] Field of Search ..... 30/34.2

[56] References Cited

U.S. PATENT DOCUMENTS

| | | | |
|---|---|---|---|
| 2,288,162 | 6/1942 | Hulst | 30/34.2 |
| 2,670,534 | 3/1954 | Haber | 30/34.2 |
| 3,138,865 | 6/1964 | Meyer | 30/34.2 |

FOREIGN PATENT DOCUMENTS

| | | | |
|---|---|---|---|
| 252785 | 4/1927 | Italy | 30/34.2 |

*Primary Examiner*—Jimmy C. Peters

[57] ABSTRACT

A hand razor assembly consisting of a plastic frame having a downwardly projecting handle with a razor guide adapted to roll the hair stubs into engagement with the blade cutting edge in a manner that will produce a closer cutting shave.

The razor blade is positioned within the frame in such a manner so that it extends generally parallel to the skin surface in a substantially conventional manner. The guide is a projection extending generally parallel to the cutting edge of the blade, sharply pointed and positioned in a plane perpendicular to the plane of the blade. The pointed edge of the guide projects above the plane of the blade and is spaced sufficiently from the blade so that it rolls the skin and the projecting hair follicles into engagement with the cutting edge of the blade in a manner substantially similar to a double bladed razor.

3 Claims, 5 Drawing Figures

HAND RAZOR ASSEMBLY

BACKGROUND OF THE PRESENT INVENTION

There have in the past been provided a plurality of guides for guiding hair follicles into engagement with the cutting edge of a razor blade for the purpose of enhancing the cutting characteristics and also for providing safe use of the razor assembly.

All of the guides heretofore known have had for their primary purpose the stretching of the skin for the purpose of flatening the skin into engagement with the cutting edge and separating the hair follicles. This concept, while certainly achieving a significant commercial acceptance, when viewed in light of the present invention, is not the most advantageous way of guiding the skin and hair follicles into engagement with the razor cutting blade edge.

One such prior construction is shown in the Gunnar P. Michelson U.S. Pat. No. 3,750,285 issued Aug. 7, 1973. This construction consists of a curved blade assembly with a rounded guide projecting forwardly therefrom. The guide serves to stretch the skin and separate the hair follicles in a conventional manner. The guide is rounded in configuration and does not extend above the plane of the cutting blade itself. Another form of the prior art is shown in the Langdon U.S. Pat. No. 2,434,275 which illustrates certain discrete guide members of U-shaped figuration at the ends of the blades for the purpose of stretching the skin, but these are resilient in construction, not pointed in configuration and do not extend above the plane of the blade member itself.

A still further form of the prior art is illustrated in the Smith U.S. Pat. No. 1,497,647 wherein a guide member 14 is provided for stretching the skin. However, as viewed clearly in the drawings of that patent and the specification, the guide member 14 does not extend above the plane of the blade, is not pointed in configuration and is also resiliently mounted so that it will yield under the normal pressures of cutting.

SUMMARY OF THE PRESENT INVENTION

According to the present invention, an improved razor blade assembly is provided in which a guide is constructed so that it will roll the skin and snap the hair follicles into engagement with the cutting edge of the razor blade. This is accomplished through the provision of a guide which is triangular in configuration and has a sharp point, the guide being integral with the plastic frame of the entire hand razor assembly. The guide achieves an effect similar to that achieved with a double bladed razor without the added cost of providing two blades. To achieve this function, the pointed guide is spaced a substantial distance from the blade cutting edge, lies in a plane perpendicular to the cutting edge and also extends a substantial distance above the plane of the blade and the blade cutting edge. As a result of this construction, the guide point significantly depresses the skin and cups the skin so that it rolls into engagement with the cutting edge and the whiskers not only project upwardly from the skin and evenly from the skin but also snap into abrupt engagement with the cutting edge producing a very smooth and deep cut of the hair follicles in a manner heretofore unknown in any of the prior art discussed above or any prior art of which applicant is aware.

DETAILED DESCRIPTION OF THE PREFERRED EMBODIMENT

Figure 1:
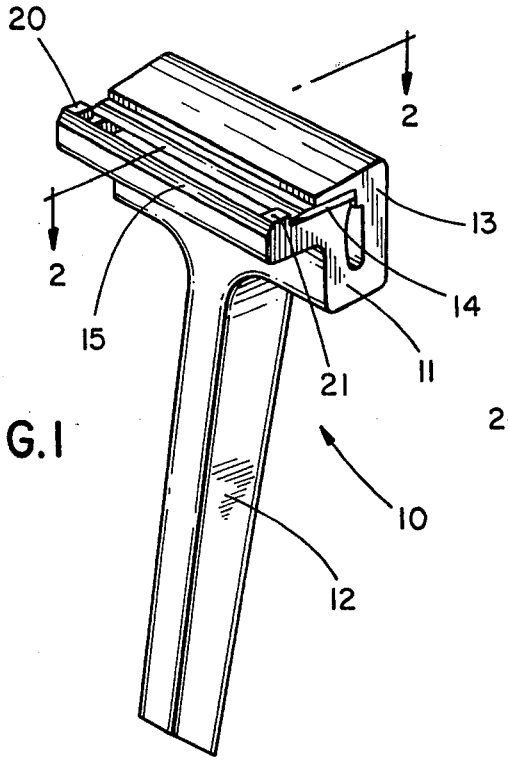
FIG. 1 is a perspective view of the present razor blade assembly.

Referring to the drawings, a razor assembly 10 is illustrated according to the present invention consisting of a frame member 11 having a generally rectangular downwardly projecting handle 12 and an upper generally U-shaped frame member 13, with a blade 14 and an integral, rigid forward guide 15.

Figure 4:
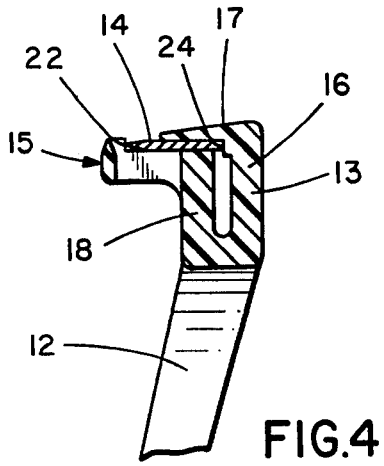
FIG. 4 is a cross-section taken generally along line 4—4 of FIG. 2.
Figure 5:
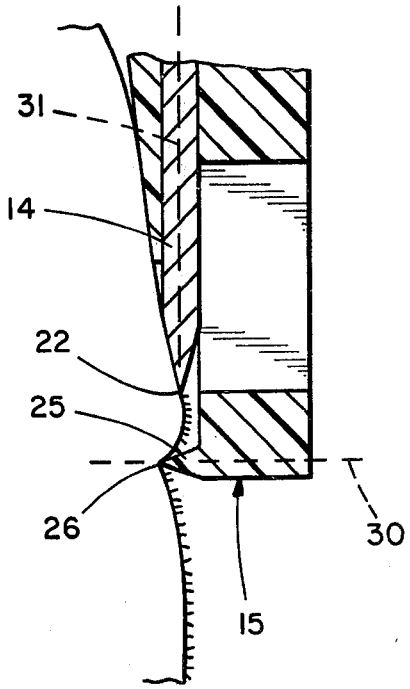
FIG. 5 is an enlarged fragmentary cross-section of the present razor blade assembly shown in contact with the skin.

As seen in FIG. 4, the upper frame portion 13 includes a vertical upstanding integral back portion 16 and a forwardly projecting portion 17 that is somewhat downwardly tapered.

Upper frame member 13 also includes a spaced upwardly projecting forward portion 18 from which guide 15 extends.

Figure 2:
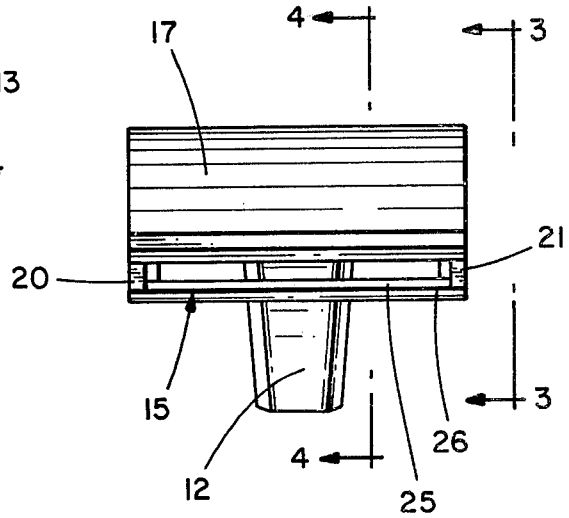
FIG. 2 is a top view of the present razor blade assembly.
Figure 3:
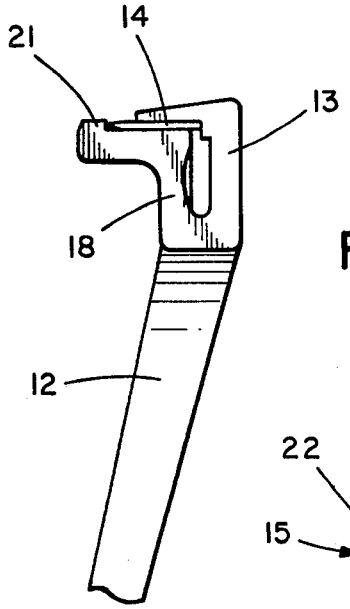
FIG. 3 is a right side view of the present razor blade assembly.

As seen more clearly in FIG. 2, the guide is generally U-shaped in configuration and consists of side tabs 20 and 21 against which the forward cutting edge 22 of the blade 14 engages and rests in position. Forwardly projecting member 17 of the frame has a recess 24 for receiving the rear edge of the blade and grasping the blade in position between the tabs 20 and 21 along with the generally resiliently constructed, grasping function of the upwardly extending portions 13 and 18 of the integral plastic frame member 11.

The guide 15 includes a triangular upwardly extending portion 25 having a sharp edge 26. An important aspect of the present invention is that the guide 15 is rigid with respect to the frame 11 and also rigid with respect to the blade 14. The triangular guide 25 extends in the plane 30 containing the edge 26 that is perpendicular to a plane 31 containing the cutting blade 14 and the cutting edge 22.

The rigid point 25 is a substantial distance from the cutting edge 22 and according to the best embodiment of the present invention, depending of course upon the size of the hair follicles to be cut, is approximately somewhat over ⅛ of an inch. A further important feature of the present invention to achieve the rolling and snap action of the hair follicles is that the depressive point 26 of the guide is a substantial distance above the vertical plane 31 of the blade 14 containing the cutting edge 22 as seen in the drawings.

In this manner, the guide 26 severely depresses the skin and rolls the hair follicles into abrupt engagement with the cutting edge 22 of the cutting blade 14 in a manner that will produce an extremely close cutting action.

What is claimed is:

1. a hand razor assembly, comprising; frame means including a downwardly projecting handle, an upper blade holding portion, a normally stationary blade in said blade holding portion, said blade having a cutting edge with a plane extending through the blade and the cutting edge, guide means generally parallel to said cutting edge, said guide means being rigid under normal cutting pressure, said guide means having an elongated pointed portion having an edge parallel with said cutting edge and extending substantially above said plane of the blade whereby the skin rolls off the rigid pointed portion into engagement with the blade cutting edge.

2. A hand razor assembly as defined in claim 1, wherein said pointed portion of said guide means extends substantially the distance of said cutting edge.

3. A hand razor assembly as defined in claim 1, wherein a second plane extends through said guide means and said elongated pointed portion, said second plane being perpendicular to said first plane.

* * * * *